United States Patent [19]

Künzel

[11] Patent Number: 4,459,127

[45] Date of Patent: Jul. 10, 1984

[54] FOLDING BOX FORM FOR DISPENSING ARTICLES

[75] Inventor: Werner Künzel, Langenfeld, Fed. Rep. of Germany

[73] Assignee: Henkel Kommanditgesellschaft auf Aktien, Dusseldorf, Fed. Rep. of Germany

[21] Appl. No.: 288,929

[22] Filed: Jul. 31, 1981

[30] Foreign Application Priority Data

Aug. 22, 1980 [DE] Fed. Rep. of Germany ..... 3031626

[51] Int. Cl.[3] ..... B65D 5/72

[52] U.S. Cl. ..... 493/69; 493/79; 493/87; 229/17 R; 221/33; 221/305

[58] Field of Search ..... 221/37, 40, 41, 45, 221/53, 55, 52, 63, 260, 305, 311, 312 C, 312 A, 312 R, 33; 206/45.18; 229/17 R, 17 B, 17 S; 493/69, 79, 87, 94, 128

[56] References Cited

U.S. PATENT DOCUMENTS

| | | | |
|---|---|---|---|
| 7,295 | 9/1876 | Osbourn | 221/63 |
| 2,137,398 | 11/1938 | Helber | 221/63 |
| 2,598,050 | 5/1952 | Guyer | 221/63 |
| 2,994,470 | 8/1961 | Engber | 221/63 |
| 3,254,793 | 6/1966 | Palmer | 221/63 |
| 3,276,622 | 10/1966 | Krzyzanowski | 221/37 |

*Primary Examiner*—Joseph J. Rolla
*Attorney, Agent, or Firm*—Ernest G. Szoke; Nelson Littell, Jr.

[57] ABSTRACT

A process for the manufacture of a folding box tube from a folding box form for dispensing articles, such as a cardboard box construction for dispensing pocket handkerchiefs, napkins, or the like, forming a box of a rectangular shape with a rectangular cross-section consisting essentially of one piece of rigid, but foldable, material adapted to be folded to give five surfaces and end closure pieces, the first and fifth surfaces, said process consisting essentially of preparing said folding box form by die cutting, folding said folding flap inwards along a folding line parallel to the bottom surface of said box when formed, folding the five surfaces to form a folding box tube and fastening the first and fifth surfaces together, wherein said folding flap at its outer extension touches the bottom surface of said folding box tube when folded, forming an overlap adapted to be fastened together to form a front surface of said box, a perforated area in said front surface adapted to be opened to the interior of the formed box, a folding flap in one of said first or fifth surfaces forming the front surface adapted to be folded inwards along a folding line parallel to the bottom surface of said box when formed and at its outer extension to touch said bottom surface.

3 Claims, 3 Drawing Figures

FOLDING BOX FORM FOR DISPENSING ARTICLES

The invention relates to a folding box form for dispensing articles, such as a cardboard box construction for dispensing pocket handkerchiefs, napkins, or the like, forming preferably square shaped dispensing box, with a front side, said box front being of preferably one piece, which essentially consists of two surfaces lying flat on top of each other in order to be joined, particularly glued together, and which front side contains a perforation opening or the like, preferably one that can be reclosed.

In cardboard packages of the kind mentioned, the pocket handkerchiefs, napkins, or the like frequently rest individually stacked. If the units are already present individually, no further means for separation in the dispensing box are necessary. It is somewhat difficult, however, to extract the lower unit of the specific pile per hand, piece by piece from the package. The dispensing opening prepared, for example, with a tear-off perforation or the like, can actually be relatively broad. However, it cannot fill out the total surface, for example, the front side of a carbon wall, since otherwise the stability of the whole box would suffer too much. Consequently, a bridge of about one quarter of the carton surface in question usually remains at the lower edge of the dispensing opening. This bridge, which is essential for the stability of the box, however, hampers the extraction of the articles resting below the edge of the bridge.

OBJECTS OF THE INVENTION

An object of the present invention is to improve a dispensing box of the kind mentioned above in such a way, that the extraction of even the last pocket handkerchiefs or the like can be achieved just as simply and individually with a single grasp as the picking up of the units situated above—and this in spite of the bridge in the surface containing the dispensing opening, which stabilizes the box.

Another object of the present invention is the development of a folding box form for dispensing articles, forming a box of a rectangular shape with a rectangular cross-section, consisting essentially of one piece of rigid, but foldable, material adapted to be folded to give five surfaces and end closure pieces, the first and fifth surfaces when folded, forming an overlap adapted to be fastened together to form a front surface of said box, a perforated area in said front surface adapted to be opened to give access to the interior of the formed box, a folding flap in one of said first or fifth surfaces forming the front surface adapted to be folded inwards along a folding line parallel to the bottom surface of said box when formed and at its outer extension to touch said bottom surface.

A further object of the present invention is the development of a process for the production of the above box.

These and other objects of the present invention will become more apparent as the description thereof proceeds.

THE DRAWINGS

DESCRIPTION OF THE INVENTION

Figure 2:
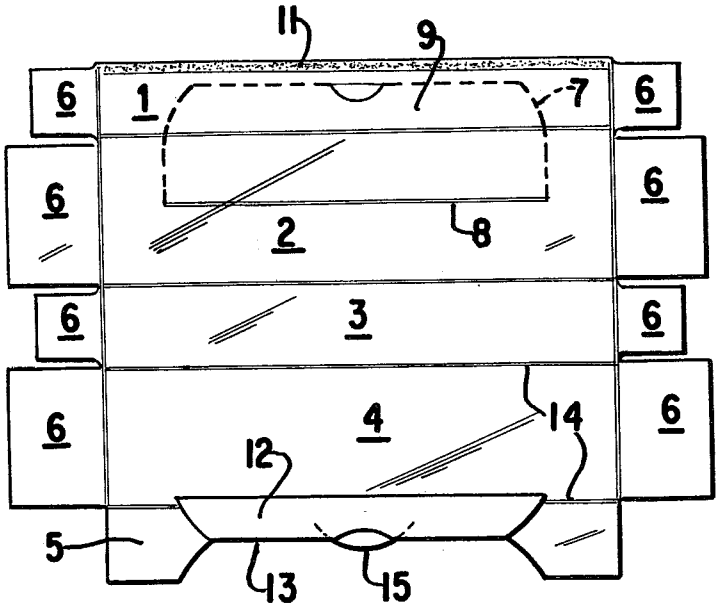
FIG. 2 is a plan view of a partially folded folding box form of FIG. 1.

The present invention relates to an improvement in a folding box form for dispensing articles, such as a cardboard box construction for dispensing pocket handkerchiefs, napkins, and the like, forming a box of a rectangular shape with a rectangular cross-section consisting essentially of one piece of rigid, but foldable, material adapted to be folded to give five surfaces and end closure pieces, the first and fifth surfaces when folded, forming an overlap adapted to be fastened together to form a front surface of said box, and a perforated area in said front surface adapted to be opened to give access to the interior of the formed box, the improvement consisting of a folding flap in one of said first or fifth surfaces forming the front surface adapted to be folded inwards along a folding line parallel to the bottom surface of said box when formed and at its outer extension to touch said bottom surface.

The invention, therefore, is characterized by a folding flap, which is to be punched out from one of the front surfaces and which is to be folded inwards along a line parallel to the box bottom and with a distance to it in such a way, as to touch the bottom surface.

With the help of this cardboard flap, which is to be folded during the first tube-forming process, for example, on a conventional folding box glueing machine, and which protracts during the erection of the package in an inward angle, the extraction of articles, such as napkins, etc., which are individually folded and stacked in the box, is considerably facilitated, because the stack of articles rests, in the area of the dispensing box opening, on top of the flap (which is folded in the direction of the cardboard bottom) in such a way, that even the articles lying in the lower part of the stack can be extracted by hand without difficulty. This is particularly valid if the perforation opening or the like comprises a larger area than the folding flap. That is to say, if the area of the front surface designated by the perforation opening reaches at least as far to the carbon longitudinal edge adjacent to the bottom surface as the opening formed by the folding flap, then the folding line of the flap folded in the direction of the cardboard box bottom extends above the edge of the opening formed by the perforation opening in such a way, that even the lowest article resting in the dispensing box can be extracted, pulling to slide, without difficulties.

For the production of the packing cardboard according to the invention, a one-piece cut of a square shaped container box can be assumed. According to further invention, the folding flap of the invention is punched out or cut out by other means from one of the two cardboard surfaces forming, depending on the construction, the front side in such a way, that it remains attached to the one piece cut of the box along the folding line mentioned above. In the tube-forming process the punched-out flap is folded in, before further folding and glueing along the box's longitudinal seam is carried out. With the appropriate design of the one-piece cut a flat resting packing can be obtained, which can be stored in a conventional way in the magazine of a cardboard box producing machine. The folding and assembling of such a prefabricated packing can be carried out in conventional ways, whereby then the folded flap of the invention automatically assumes the desired angular position, touching the bottom surface of the box with its free end.

The loading of the package of the invention with handkerchiefs, napkins or the like, can be done by inserting the same from the side. In the last operation, the package can be closed at the sides with, for example, precut completely covering flaps, for example, by glueing. For opening, the package has a perforated opening flap or the like. The front surface of the cardboard, which contains the perforated opening flap, is designed suitably in such a way, that its lower portion, which is nearest the box's bottom, remains as bridge while the opening corresponding to the perforated opening flap is being formed. This bridge, as already mentioned, is important for the mechanical stability of the dispensing box.

Since the folding flap according to the invention is punched out from a rigid, but foldable surface, which must be cut in any event, there is no need for additional material in carrying out the invention. It is of further advantage that the tube forming, supplying and closing, that is, the erecting and loading of the box, can be carried out on conventional folding box/glueing machines or carton producers.

The advantage of the folding flap along the bottom and directed towards the interior according to the invention, namely, a better way of extracting particularly the lower articles from the pile, is that this can be achieved without additional effort.

Figure 3:
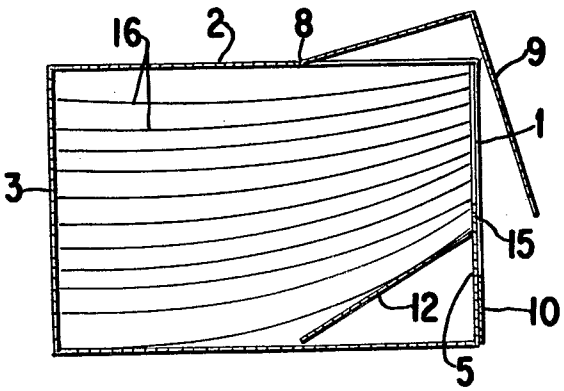
FIG. 3 is a cross-section of the box as assembled perpendicular to the longitudinal surfaces of the box.
Figure 1:
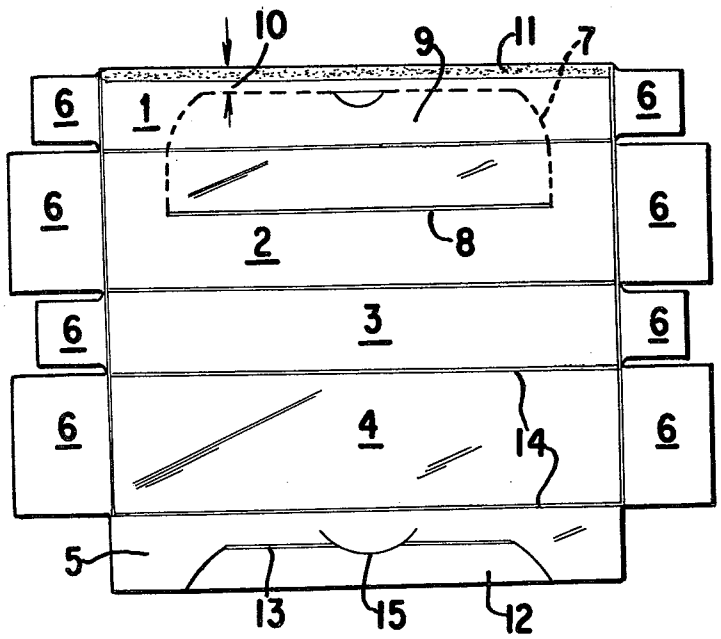
FIG. 1 is a plane view of the folding box form for the manufacture of a carton package.

The drawings explain further details of the invention. These consist of:

FIG. 1 is a plane view of a flat-resting precut assembly for the manufacturing of a carton package, FIG. 2 is a plane view of a partially folded precut assembly according to FIG. 1, and FIG. 3 is a cross-section of the box as assembled perpendicular to the longitudinal surfaces of the box.

The precut assembly according to FIGS. 1 and 2 comprises the longitudinal surfaces 1 to 5 and the side tuck flaps 6. In FIG. 3 the long sides 1 to 5 are shown in cross section. Obviously, when erected, the long sides 1 and 5 jointly form the front surface of the package. The top surface 2 and the bottom surface 4 of the package adjoin the front surface, which consists of parts 1 and 5. A perforated area 7 or the like is perforated in the outer cardboard surface 1 of the front side and optionally partially also in the top side 2 in such a way, that after opening of the packing, a flap 9 is formed, which can hinge around the folding line 8. This flap 9 is opened, when articles, such as pocket handkerchiefs, napkins or the like, particularly of paper, are to be taken from the package.

In order not to unduly weaken the cardboard surfaces or the whole cardboard box, a certain bridge area 10 is to be left, as illustrated, also in the longitudinal surface 1, which forms part of the front side. This bridge area 10 also serves to glue or to join in some other manner the longitudinal surface 1 with its glue seam 11 to the box surface 5 lying opposite in the precut assembly.

In the Example, a folding flap 12 according to the invention is punched out from the longitudinal surface 5, which is diametrically opposite to the longitudinal surface 1 containing the perforated area 7. This folding flap 12 is folded in such a way, that its free end stands upright with reference to the precut assembly and that its folding line 13 runs about parallel to the folding line 8 mentioned previously. The distance between the folding line 13 of the folding flap 12 and the adjacent folding line 14 between the longitudinal surface 5 and the remainder of the precut assembly should preferably be at least as large as the bridge area 10 remaining in the longitudinal surface 1. The tube forming and carbon making are simplified if the longitudinal surface 5 containing the folding flap 12 is prepared in the precut assembly somewhat longer than the opposite longitudinal surface 1, for example, about one third longer. Then during the punching of the folding flap 12, the remainder of the longitudinal surface 5 is somewhat shortened to be of the same length as the opposite longitudinal surface 1. In this manner the folding flap 12 will extend somewhat further on the order of one third further, into the assembled box.

Furthermore, during punching of the folding flap 12, a tongue 15, which intersects with its folding line 13 can be punched out, which serves in the erected cardboard box as means (tuck end) for the reclosing of the flap 9, which is formed by the perforation area 7.

On tube forming and assembling the package, the folding flap 12 is folded along the folding line 13 inwards on the precut assembly as the first operation. As second operation, the folding of the longitudinal surfaces 4 and 5 follows together with the flap 12. Only then during the tube forming process, the longitudinal surface 1 is folded and glued to the strip of longitudinal surface 5 adjoining the folding line 14 or joined in another manner. The inward-folded flap 12 of the prefabricated packing is necessarily assembled into the desired angular position in such a way, that the contents 16 consisting of individual handkerchiefs, napkins, or the like, rest in the area of the opening formed by flap 9 above the lower edge formed by the bridge 10.

The preceding specific embodiment is illustrative of the practice of the invention. It is to be understood, however, that other expedients known to those skilled in the art or disclosed herein, may be utilized without departing from the spirit of the invention or the scope of the appended claims.

I claim:

1. A process for the manufacture of a folding box tube from a folding box form for dispensing articles, such as a cardboard box construction for dispensing pocket handkerchiefs, napkins, or the like, forming a box of a rectangular shape with a rectangular cross-section consisting essentially of one piece of rigid, but foldable, material adapted to be folded to give five surfaces and end closure pieces, the first and fifth surfaces when folded, forming an overlap adapted to be fastened together to form a front surface of said box, a perforated area in said front surface adapted to be opened along a hinge line parallel to the folding seams of said five surfaces to the interior of the formed box, a folding flap in one of said first or fifth surfaces forming the front surface adapted to be folded inwards along a folding line parallel to the bottom surface of said box when formed and at its outer extension to touch said bottom surface, wherein said perforated area is larger than said folding flap area and reaches as close to said front surface longitudinal edge as said folding flap folding line, said process consisting essentially of mechanically preparing said folding box form by die cutting, mechanically folding said folding flap inwards along a folding line parallel to the bottom surface of said box when formed, mechanically folding the five surfaces to form a folding box tube and mechanically glueing the first and fifth surfaces together, wherein said folding flap at its outer extension touches the bottom surface of said folding box tube.

2. The process of claim 1 wherein said perforated area is larger than said folding flap area.

3. The process of claim 1 wherein said perforated area in said front surface reaches as close to said front surface bottom longitudinal edge as said folding flap folding line.

* * * * *